US007356974B2

(12) United States Patent
Tadich

(10) Patent No.: US 7,356,974 B2
(45) Date of Patent: Apr. 15, 2008

(54) STRUCTURAL TRUSS AND METHOD FOR FORMING A STRUCTURAL TRUSS

(75) Inventor: John Tadich, Knoxfield (AU)

(73) Assignee: MiTek Holdings, Inc., Wilmington, DE (US)

( * ) Notice: Subject to any disclaimer, the term of this patent is extended or adjusted under 35 U.S.C. 154(b) by 252 days.

(21) Appl. No.: 10/857,089

(22) Filed: May 28, 2004

(65) Prior Publication Data

US 2004/0261350 A1 Dec. 30, 2004

(30) Foreign Application Priority Data

Jun. 24, 2003 (AU) ..... 2003903215

(51) Int. Cl.
*E04C 3/30* (2006.01)

(52) U.S. Cl. ..... 52/737.3; 52/696; 52/690; 52/692

(58) Field of Classification Search ..... 52/693, 52/636, 690, 692, 729.4, 730.7, 696, 737.3, 52/363, 390, 393, 392
See application file for complete search history.

(56) References Cited

U.S. PATENT DOCUMENTS

| | | | | |
|---|---|---|---|---|
| 4,157,676 | A * | 6/1979 | Jureit | 411/458 |
| 4,207,719 | A | 6/1980 | Knowles | |
| 4,501,102 | A | 2/1985 | Knowles | |
| 4,659,604 | A * | 4/1987 | Lambuth | 428/99 |
| 5,234,279 | A * | 8/1993 | Poutanen | 403/403 |
| 5,560,177 | A | 10/1996 | Brightwell | |
| 5,592,800 | A * | 1/1997 | Koo et al. | 52/692 |
| 5,761,872 | A * | 6/1998 | Sanford et al. | 52/694 |
| 5,833,222 | A | 11/1998 | Olden et al. | |
| 5,867,962 | A * | 2/1999 | Scott et al. | 52/696 |
| 5,867,963 | A * | 2/1999 | Hershey | 52/729.4 |
| 6,158,189 | A * | 12/2000 | Lau | 52/729.4 |
| 2002/0007611 | A1 * | 1/2002 | Sanford et al. | 52/694 |

FOREIGN PATENT DOCUMENTS

| | | |
|---|---|---|
| DE | 803253 | 4/1951 |
| EP | 1 030 000 A1 | 8/2000 |
| FR | 2554482 A1 | 5/1985 |
| WO | 0045006 A1 | 8/2000 |

OTHER PUBLICATIONS

Promotional Flyer for FITFAST I-JOIST dated Nov. 4, 2002, 2 pages.

* cited by examiner

*Primary Examiner*—Jeanette Chapman
*Assistant Examiner*—Elizabeth A Plummer
(74) *Attorney, Agent, or Firm*—Senniger Powers

(57) ABSTRACT

A structural truss and method of forming a truss is disclosed. The truss includes an end configuration which does not rely on gluing components together. The end configuration is formed from a web which extends between the top and bottom chords of the truss and a connector system for connecting the web to both of those chords inwardly of the first ends of the chords. In another arrangement, the end configuration is a prefabricated end configuration comprised of top and bottom chord members and a web located between the top and bottom chord members.

8 Claims, 5 Drawing Sheets

STRUCTURAL TRUSS AND METHOD FOR FORMING A STRUCTURAL TRUSS

FIELD OF THE INVENTION

This invention relates to a structural truss and method for forming a truss so that the truss can be trimmed to length to enable the truss to be made a desired length for inclusion in a building framework.

BACKGROUND OF THE INVENTION

Structural trusses are used in a variety of different building installations in order to provide beams and other structural members which are intended to take load within the building framework. Structural trusses of a variety of predetermined lengths may therefore be required in order to fit a particular framework design. In the past, this has necessitated the fabrication of trusses having a number of different lengths so that a suitable length can be selected for installation in the framework.

However, in more recent times, structural trusses have been proposed which have at least one end configuration which enables the truss to be trimmed to a desired length, thereby enabling a truss of one length to be made, and for the truss to be trimmed in order to fit the particular framework in which the truss is to be installed.

Conventional end configurations generally include a web which is glued between upper and lower chords of the truss. The chord is completed by a plurality of intermediate struts which connect the top and bottom chords intermediate the end configuration of the truss and the opposite end of the truss. The intermediate struts are normally connected to the chords by a pressing operation in which connector plates having punched teeth are pressed to connect the struts to the chords. The struts may be made from metal and the connector plates may be an integral part of the struts, or the struts may be wooden struts and the connector plates may be discrete plates which are used to connect the struts to the chords. The web may be located in grooves formed in the facing surfaces of the chords in order to further strengthen the connection of the web to the chords.

The manufacturing sequence of such trusses usually is to glue the web in place between the chords and then leave the partly completed truss for a period of time to enable the glue to cure so that the web is securely attached between the chords. When the glue has cured, the truss is then completed in a pressing operation by attaching the intermediate struts between the chords.

The manufacturing technique which relies on the use of glue does not fit well with the remainder of the manufacturing technique which basically relies upon pressing technology to secure the remaining components of the truss together. Furthermore, the need to glue the web at the end of the truss means that manufacturing time is relatively long in view of the need for the glue to cure before the truss can be completed.

SUMMARY OF THE INVENTION

Among the several objects of an exemplary embodiment of the invention is to provide a truss and method of forming a truss which does not rely on gluing components together in the fabrication of the truss.

In general, a structural truss of the present invention comprises a top chord having a first end and a bottom chord having a first end. An end configuration has a web comprising a one-piece web member which extends between and interconnects the top chord and bottom chord. The web extends between an intermediate position and the first ends of the top chord and bottom chord. A connector system is for connecting the web to both of the chords inwardly of the first ends of the chords so the entire load applied to the end configuration of the truss when the truss is in use is transferred from the chords to the web inwardly of the first ends of the chords. The truss is trimmable to a predetermined length by cutting the truss through the chords and the web at a location between the first ends of the chords and the intermediate position without effecting the structural integrity of the end configuration.

In another aspect, a structural truss of the invention comprises a top chord and a bottom chord. A prefabricated end configuration is comprised of a top chord member having a first end, a bottom chord member having a first end, and a web located between and interconnecting the top chord member and the bottom chord member. At least one connector system is for connecting the top and bottom chords to the top chord member and bottom chord member inwardly of the first ends so load is transmitted to the web inwardly of the first ends. An end strut extends substantially perpendicularly between the top chord and bottom chord adjacent the end configuration and connected by the connector system to the top chord and bottom chord. The end configuration is trimmable to length by cutting the end configuration through the top chord member, the bottom chord member and the web.

Other objects and features will be in part apparent and in part pointed out hereinafter.

BRIEF DESCRIPTION OF THE DRAWINGS

Preferred embodiments of the invention will be described, by way of example, with reference to the accompanying drawings in which.

Corresponding reference characters indicate corresponding parts throughout the several views of the drawings.

DETAILED DESCRIPTION OF THE PREFERRED EMBODIMENTS

Figure 1:
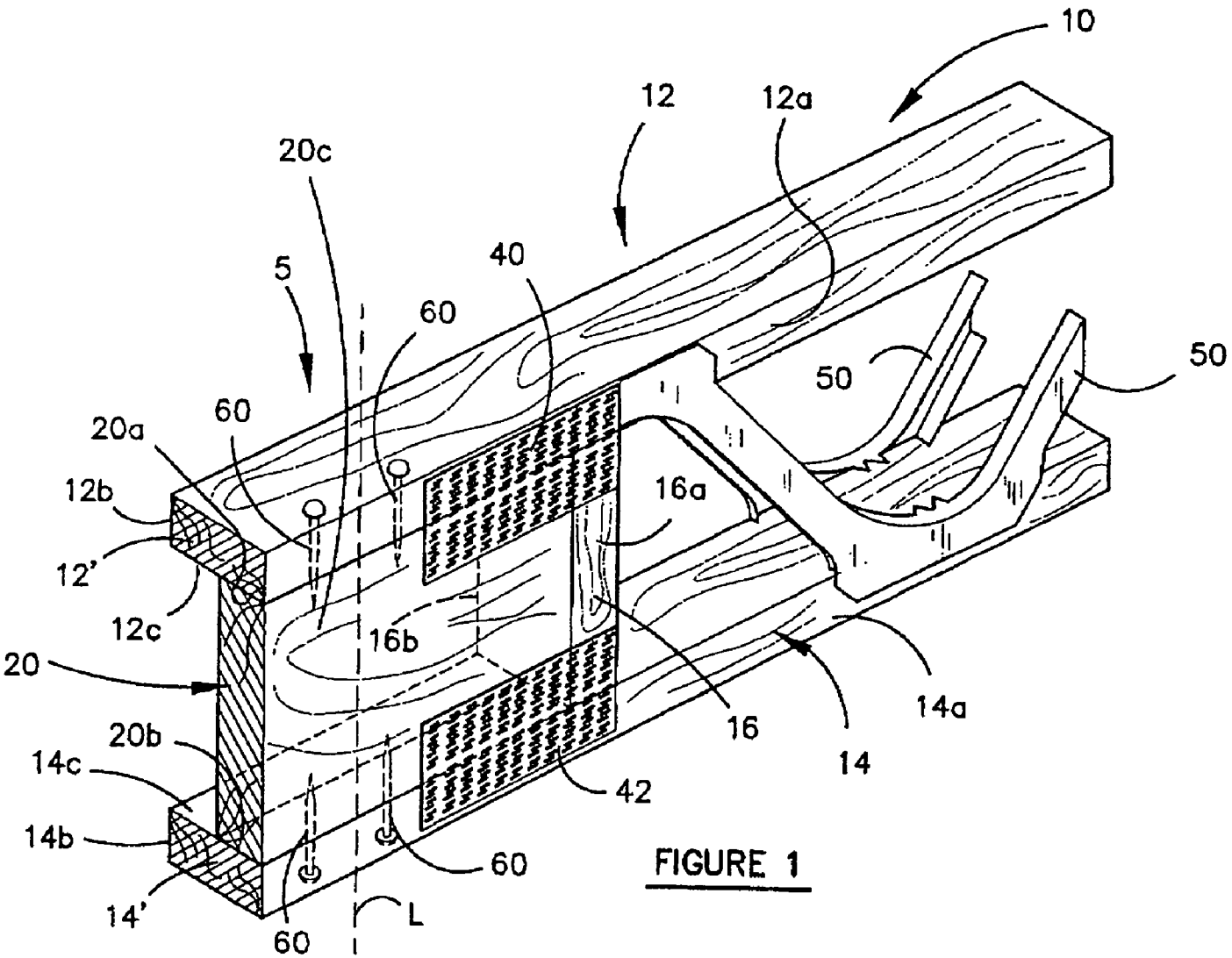
FIG. 1 is a perspective view of an end configuration of a structural truss according to a first embodiment of the invention.

With reference to FIG. 1, a truss 10 is shown which has a top chord 12 and a bottom chord 14. An end strut 16 extends between the chords 12 and 14 and is substantially the same width as the chords 12 and 14 so side faces 16*a* and 16*b* of the strut 16 are generally flush with faces 12*a* and 14*a*, and 12*b* and 14*b* respectively of the chords 12 and 14. The faces 16*a* and 16*b*, and the faces 12*a*, 12*b*, 14*a* and 14*b* are arranged substantially vertically when the truss is installed in a building framework. The chords 12 and 14 and the strut 16 are made from wood.

The chords 12 and 14 have first ends 12' and 14' respectively. A wooden web 20 is arranged between the chords 12 and 14 and has faces 20*a* and 20*b* which abut faces 12*c* and 14*c* of the chords 12 and 14.

The web 20 also has a face 20*c* which is arranged vertically when the truss is installed in a building framework. As can be seen in FIG. 1, the web 20 is located to one side of the chords 12 and 14 so that the face 20*c* is generally flush with the faces 12*a* and 14*a* of the chords 12 and 14, and also the face 16*a* of the strut 16. Thus, the truss 10 has an end configuration 5 which is C-shaped in vertical cross-section through the chord 12, the web 20 and the chord 14.

The web 20 is connected to the strut 16 and the strut 16 is connected to the chords 12 and 14 by first and second connector plates 40 and 42. The connector plates 40 and 42 are punched tooth connector plates and are applied to the truss in a pressing operation so that the punched teeth penetrate the chords 12 and 14 (as the case may be) and the web 20 as well as the strut 16.

As is apparent from FIG. 1, the plate 40 overlaps the face 12*a* of the chord 12, the face 16*a* of the strut 16 and the face 20*c* of the web 20 and therefore connects the web 20 to both the strut 16 and the chord 12, and also connects the strut 16 to the chord 12. Similarly, the connector plate 42 overlaps the face 16*a* of the strut 16, the face 20*c* of the web 20 and the face 14*a* of the chord 14, and therefore connects the web 20 to both the chord 14 and the strut 16, as well as the strut 16 to the chord 14.

The truss also includes a plurality of intermediate struts 50 which are preferably in the form of metal struts manufactured by MiTek Australia Pty Ltd and sold under the trade name POSI-STRUT (Registered Trademark). Such struts are well known, as is there mode of connection, and therefore will not be further described herein. Suffice to say that the struts extend along the length of the truss 10 between the ends of the truss 10.

The opposite end of the truss 10 (which is not shown in FIG. 1) may include an end configuration which is a mirror image of the end configuration 5 shown in FIG. 1, or alternatively, the struts 50 may simply extend to the opposite end.

The end configuration shown in FIG. 1 enables the truss 10 to be trimmed to a desired length by cutting the truss along a vertical line, such as that shown by dotted line L, so as to trim the length of the truss to a desired length for installation in a building framework.

To hold the web 20 to the chords 12 and 14 prior to connection of the plates 40 and 42, nails 60 may be hammered through the chords 12 and 14 into the web 20.

When the truss is installed in a building configuration and is loaded, load is transferred from the chords 12 and 14 to the strut 16 and to the web 20 via the connector plates 40 and 42. Thus, if the chord is trimmed along the line L, or a line parallel to the line L, the structural integrity of the truss is not effected.

The truss of FIG. 1 can be formed solely in a pressing operation where the chords 12 and 14, strut 16 and web 20 are laid out on a suitable support, and the plates 40 and 42 pressed into the chords 12 and 14, strut 16 and web 20, and also the struts 50 pressed so as to connect those struts to the chords 12 and 14. Thus, the location of the web 20 at the end of the truss does not rely on gluing in order to maintain structural integrity should the truss be trimmed, and therefore the truss can be much more quickly and conveniently manufactured in a pressing operation.

The structure described with reference to FIG. 1 provides the advantage that the truss can be made in one operation, and also the connector plates are applied to only one side of the truss, which makes the pressing operation easier. Furthermore, the structure of FIG. 1 results in less components, and therefore fewer connections, and the structure is therefore more rigid because of the fewer number of components and the fewer connections which are needed.

Furthermore, in the structure shown in FIG. 1, whilst it is obviously preferable to use two connector plates 40 and 42 to make up the connector system which joins the web 20 to the chords 12 and 14, a single large connector plate which overlies the chords 12 and 14, the strut 16 and also the web 20 could be used.

The connection of the web 20 to the chords by the connector plates 40, 42 enables the structural integrity at the end of the truss to be provided whilst allowing the truss to be trimmed to length, without the need to rely on gluing during the fabrication of the truss itself. Thus, the truss can be formed more quickly, entirely in a pressing operation, whilst providing structural integrity at the end of the truss to enable trimming of the truss to a predetermined length. Furthermore, the ability to avoid gluing and the use of a connector system overcomes problems with ascertaining whether the glued structure is effective. In this regard, the issue of whether a glued structure does have the required structural integrity can generally only be determined if the truss is tested because it may not be apparent on a visual inspection of whether the glue has properly taken and adhered the components together. The use of a connector system enables a visual inspection to be made to determine whether the joint is effective, and therefore quality control is much easier. Furthermore, the ability to avoid using glue results in a safer operation because some glues used in the formation of trusses are toxic and may therefore involve health issues or the need for workmen to use safety equipment in the formation of the truss to protect against the toxicity of the glue.

Figure 2:
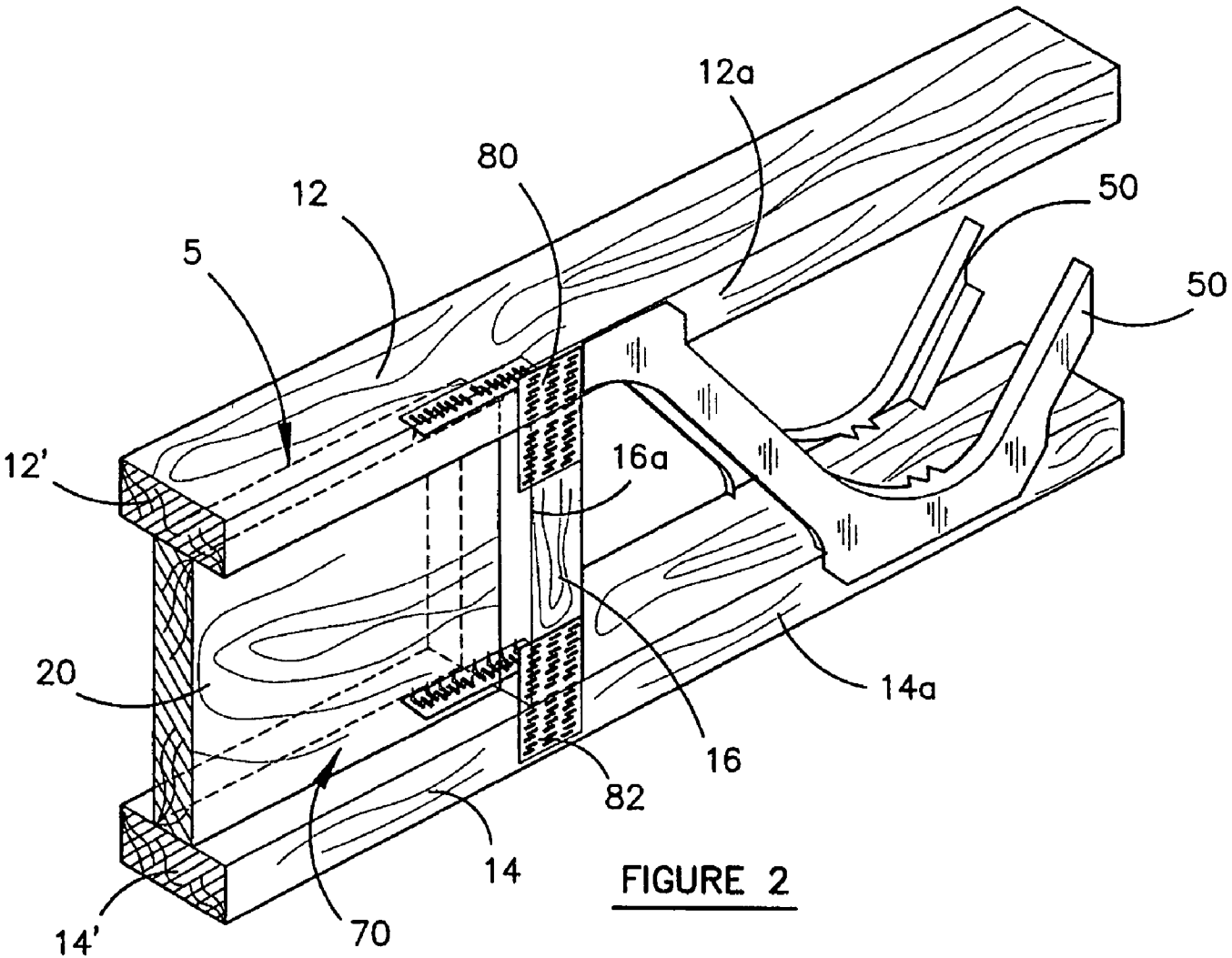
FIG. 2 is a view similar to FIG. 1 but of a second embodiment of the invention.

FIG. 2 shows a second embodiment of the invention in which like reference numerals indicate like parts to those previously described.

In this embodiment, the web 20 is located substantially centrally of the chords 12 and 14 so that in cross-section, the end configuration 5 is of I-shape rather than C-shape as in the embodiment of FIG. 1.

Figure 3:
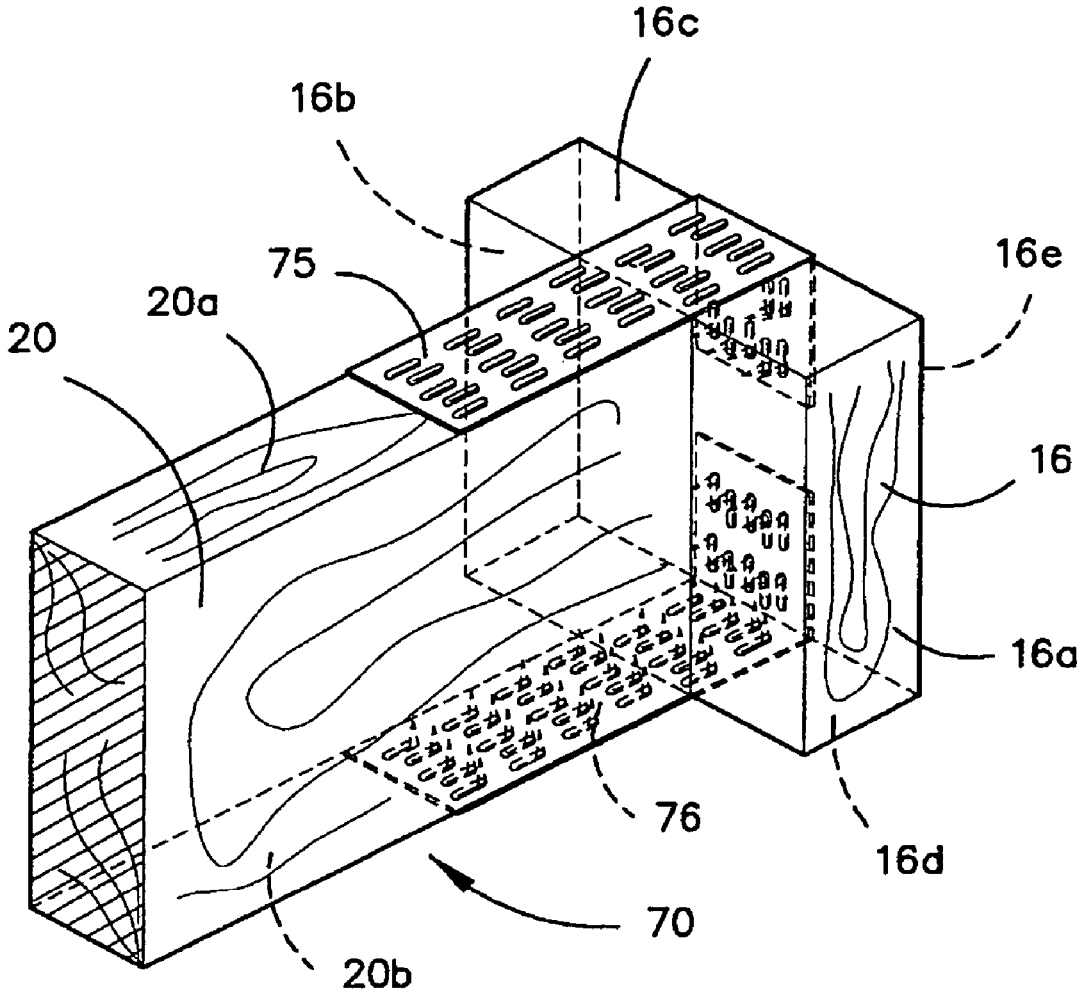
FIG. 3 is a view of part of the truss of FIG. 2.

Furthermore, in this embodiment the web 20 is connected to the strut 16 in a preliminary operation so as to form a strut and web assembly 70 as shown in FIG. 3. As is shown in FIG. 3, the web 20 is connected to the strut 16 by first and second web connector plates 75 and 76 which overlap faces 20*a* and 20*b* of the web 20, and also faces 16*c* and 16*d* of the strut 16. The connector plates 75 and 76 preferably overlap and extend at least partly along face 16*e* of the strut 16.

The first web connector plate 75 overlaps first face 20*a* of the web and first face 16*c* of the strut which are arranged substantially horizontally when the truss is installed in a building framework. The second web connector plate 76 overlaps second face 20*b* of the web and second face 16*d* of the strut which are also arranged substantially horizontally when the web is installed in a building framework.

Whilst in the embodiment shown, two connector plates 75 and 76 are provided, the connector plates 75 and 76 can be provided by a single connector plate strip which wraps all the way along the face 16*e* of the strut 16.

At least one connector plate for connecting the strut to the top and bottom chords. The web and strut assembly 70 is located between the chords 12 and 14 as shown in FIG. 2, and the strut 16 is connected to the chords 12 and 14 by connector plates 80 and 82 which respectively overlaps the face 16*a* of the strut 16 and the face 12*a* of the chord 12, and the face 16*a* of the strut 16 and the face 14*a* of the chord 14.

Load applied to the chords 12 and 14 is transferred to the strut 16 and then to the web 20. Load is transferred entirely inwardly of the ends 12' and 14' of the chords 12 and 14 into the web 20 so that when the truss 10 is trimmed, the structural integrity of the truss at the end configuration 5 of the truss is not adversely effected.

Thus, the truss can be easily manufactured and then trimmed to a desired length for installation in a building framework.

Figure 4:
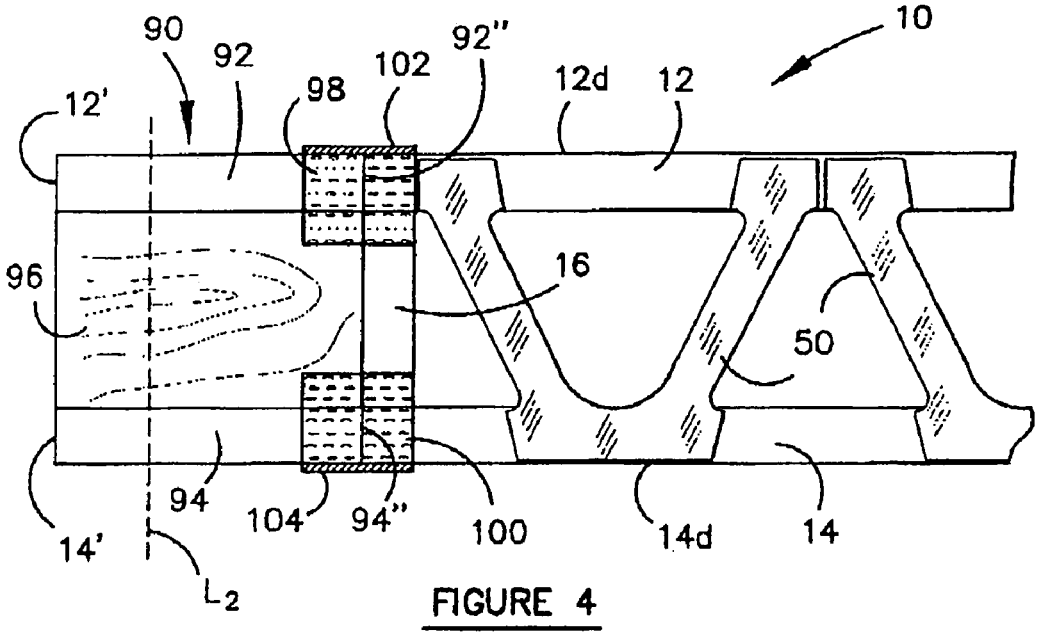
FIG. 4 is a view of a third embodiment of the invention.
Figure 5:
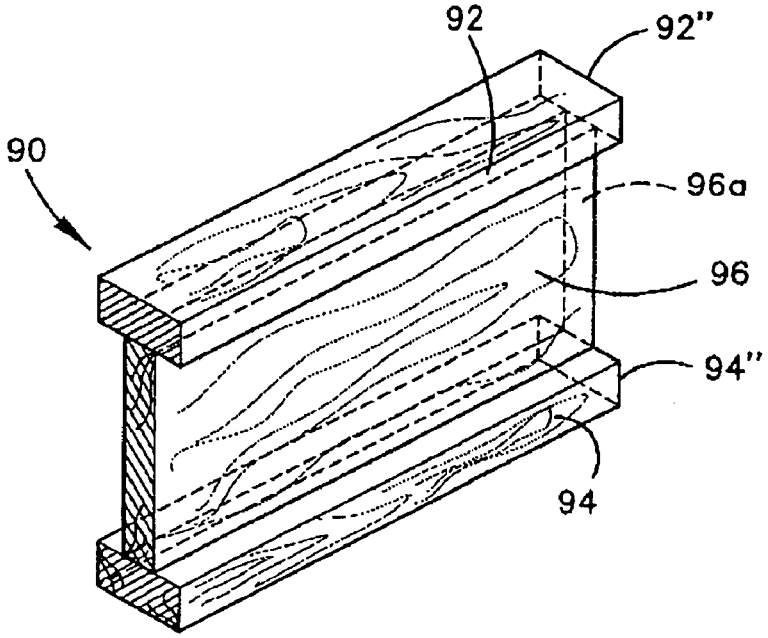
FIG. 5 is a view of one of the components used in the embodiment of FIG. 4.

With reference to FIGS. 4 and 5, in which like reference numerals indicate like parts to those previously described, a third embodiment of the invention includes an end configuration 90 formed from a top chord member 92 and a bottom chord member 94. A web 96 is located between the chord members 92 and 94, and attached to the chord members 92 and 94 by glue. The end configuration 90 is prefabricated and may be made in discrete small lengths, or may be in the form of an elongate beam so that discrete lengths can be cut from the beam to provide the respective end configurations 90 for attachment to the truss, as will be described below.

In the embodiment of FIG. 4, the truss end configuration is completed by connecting the end configuration 90 to the chords 12 and 14 by abutting the ends 92" and 94" to the ends of the chords 12 and 14 so the chord members 92 and 94 form a continuation of the chords 12 and 14 to provide the ends 12' and 14' at the end of the end configuration 90 as shown in FIG. 4.

The chord member 92 is connected to the chord 12 by a connector plate 98 which overlaps the chord member 92 and the chord 12. The chord member 94 is connected to the chord 14 by a connector plate 100 which overlaps the chord member 94 and the chord 14.

If desired, or instead of the plates 98 and 100, connector plates 102 and 104 may be located on the upper face 12*d* of the chord 12 and chord member 92, and on the lower face 14*d* of the chord 14 and chord member 94.

In this embodiment, load is transmitted from the chords 12 and 14 through the connector plates 98 and 100 (and/or 102 and 104) to the chord members 92 and 94 and then to the web 96. An end strut 16 is provided at the ends of the chords 12 and 14 so that the inner face 96*a* of the web 96 is arranged adjacent the strut 16. The connector plates 98 and 104 can also overlap the strut 16 so that they also connect to the strut 16. The parts of the connector plates 98 and 104 which extend over the web 96 do not make any connection.

The truss 10 is trimmed to length by cutting through the chord members 92 and 94 and the web 96, for example, along vertical line L2.

Since the load is transmitted to the web 96 inwardly of the ends 12' and 14', the cutting of the truss along the line L2 does not interfere with the structural integrity of the end configuration of the truss 10.

Thus, the third embodiment is concerned with providing a truss which has an end configuration which allows trimming of the truss to length which may include glued components, but which nevertheless enables the truss fabricator to form the truss solely in a pressing operation. According to this embodiment, the end configuration can be prefabricated either onsite or offsite separate from the manufacture of the truss. The prefabricated end configuration may be formed by gluing or by any other suitable assembly process. Since the prefabricated end configuration is formed separate from the truss manufacture, it does not interfere or slow down truss manufacturing, and in order to manufacture the truss, the end configuration is simply connected to the top and bottom chords in the manner described above. The end strut ensures loads are transmitted between the chords and the web in both a downward load direction and an upward load direction.

Figure 6:
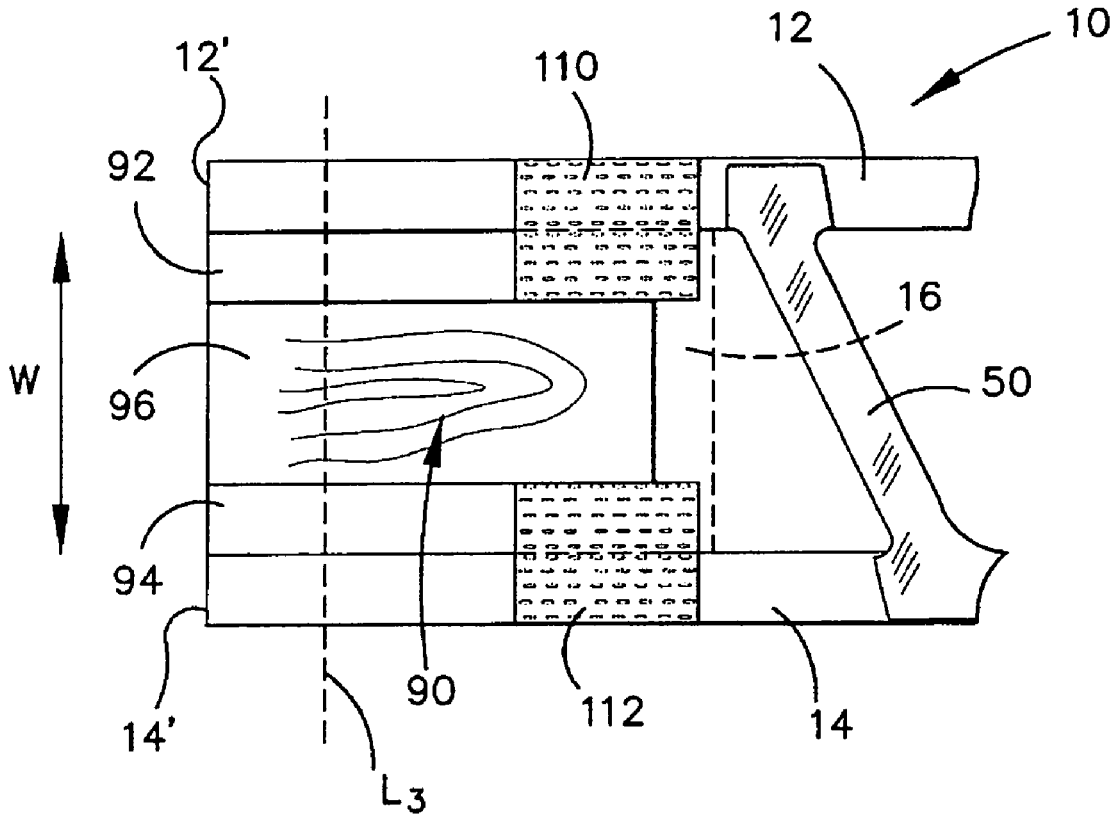
FIG. 6 is a view of a fourth embodiment of this invention.

In FIG. 6, a fourth embodiment of the invention includes a prefabricated end configuration 90 which is arranged so that it is located between the chords 12 and 14. Therefore, in this embodiment, the end configuration 90 is of smaller width W than the width of the truss 10, whereas in the embodiment of FIGS. 4 and 5, the end configuration 90 is obviously the same width as the remainder of the truss 10.

In this fourth embodiment, the chord 12 is connected to the chord member 92 by a connector plate 110 which overlaps the chord 12 and the chord member 92 inwardly of the end 12'. A second connector plate 112 overlaps the chord 14 and the chord member 94 inwardly of the end 14'. The connector plates 110 and 112 may also overlap the strut 16 to provide additional structural integrity.

The truss 10 of the embodiment of FIG. 6 is trimmed by cutting through the chord members 92 and 94, the web 96 (and of course also the chords 12 and 14 as shown by dotted line L3 in FIG. 6).

Because the end configurations 90 are prefabricated, the truss 10 is still formed by assembling the components and pressing the connector plates 98, 100 (and/or 102 and 104), and 110 and 112, together with the struts 50 so that the truss is fabricated in a pressing operation. Thus, although the end configuration 90 is formed by gluing, the fact that it is prefabricated for use in the truss manufacture means that the manufacturing process of the truss is not delayed, and no actual gluing is needed in the assembly and fabrication of the truss 10 itself.

If the structural truss is to be used in an environment where squeaking may be of concern, such as in the floor of a building, an elastomer or like sheet or layer can be located between the web 20 and the chords 12 and 14 in the embodiments of FIGS. 1 and 2, or between the chord members 92 and 94 and the chords 12 and 14 in the embodiment of FIG. 6. If desired, the elastomer may have some adhesive property, although it should be understood that the adhesive is not required in order to structurally attach the webs 20 or 96 to the remainder of the truss 10, but is merely provided to prevent squeaking when load is applied to the truss. Thus, the layer, even if it does include an adhesive property, does not need to cure before the truss is completely fabricated and therefore does not interfere with the formation of the truss in a pressing operation.

The provision of the end strut 16 in the embodiments of FIGS. 4 to 6 is of extreme importance because it ensures that loads both in a downward direction and an upward direction are transmitted between the chords 12 and 14 and the web 96. One of the primary applications of the truss of the preferred embodiment is in roof applications where the truss needs to support the weight of the roof or, in other words, a downward or compressive type load as well as being able to resist wind loads which produce an upward load or tension load on the truss. In order to resist the upward loads, the end strut 16 needs to be substantially perpendicular to the chords 12 and 14. Unless the substantially perpendicular end strut 16 is included, the upward or tension loads are likely to break the glue bond between the web 96 and the chord members 92 and 94. The perpendicular end strut 16 provides a path for those loads so that the glue joint between the web 96 and the chord members 92 and 94 is not subjected to those loads.

In the claims which follow and in the preceding description of the invention, except where the context requires otherwise due to express language or necessary implication, the word "comprise", or variations such as "comprises" or "comprising", is used in an inclusive sense, ie. to specify the presence of the stated features but not to preclude the presence or addition of further features in various embodiments of the invention.

Since modifications within the spirit and scope of the invention may readily be effected by persons skilled within the art, it is to be understood that this invention is not limited to the particular embodiment described by way of example hereinabove.

What is claimed is:

1. A structural truss comprising:

a top chord having a first end; a bottom chord having a first end;

and an end configuration having:

(a) a web comprising a one-piece web member which extends between and interconnects the top chord and bottom chord, the web extending between an intermediate position and the first ends of the top chord and bottom chord; and (b) a connector plate system for connecting the web to both of the chords inwardly of the first ends of the chords so the entire load applied to the end configuration of the truss when the truss is in use is transferred from the chords to the web inwardly of the first ends of the chords;

(c) a strut between the top and bottom chords adjacent an inner end of the web; and wherein the truss is trimmable to a predetermined length by cutting the truss through the chords and the web at a location between the first ends of the chords and the intermediate position without affecting the structural integrity of the end configuration, wherein the web is located substantially centrally with respect to the top and bottom chords so that the truss at a location between the strut and the first ends is I-shaped in cross-section, and wherein the connector plate system comprises a first web connector plate which overlaps a first face of the web and a first face of the strut which are arranged substantially horizontally when the truss is installed in a building framework, and a second web connector plate which overlaps a second face of the web and a second face of the strut which are also arranged substantially horizontally when the web is installed in a building framework, and at least one connector plate for connecting the strut to the top and bottom chords.

2. The truss of claim 1 wherein the connector plates have punched teeth for penetrating the chords, the web and the strut.

3. The truss of claim 1 wherein said at least one connector plate for connecting the strut to the top and bottom chords comprises two connector plates, a first of said connector plates overlapping the strut and the top chord, and a second of said connector plates overlapping the strut and the bottom chord.

4. The truss of claim 3 wherein a plurality of intermediate struts are provided which interconnect the top chord and the bottom chord along at least part of the length of the truss.

5. The truss of claim 3 wherein the strut is a wooden strut.

6. The truss of claim 3 wherein the chords and web are wooden.

7. A structural truss comprising:

a top chord;

a bottom chord;

a prefabricated end configuration comprised of a top chord member having a first end, a bottom chord member having a first end, and a web located between and interconnecting the top chord member and the bottom chord member;

at least one connector system for connecting the top and bottom chords to the top chord member and bottom chord member inwardly of the first ends so load is transmitted to the web inwardly of the first ends;

an end strut extending substantially perpendicularly between the top chord and bottom chord adjacent the end configuration and connected by the connector system to the top chord and bottom chord; and wherein the end configuration is trimmable to length by cutting the end configuration through the top chord member, the bottom chord member and the web;

wherein the top chord member and bottom chord member abut ends of the top chord and bottom chord, and therefore form extensions of the top chord and bottom chord.

8. The truss of claim 7 wherein the connector system comprises two connector plates, a first of the connector plates overlapping the top chord, the top chord member and the end strut, and the second connector plate overlapping the bottom chord, the bottom chord member and the end strut.

* * * * *